US009868074B2

(12) United States Patent
Wilhite

(10) Patent No.: US 9,868,074 B2
(45) Date of Patent: Jan. 16, 2018

(54) DEVICE FOR FIRE, LIGHT AND DANCE PERFORMANCE

(71) Applicant: Milo John Wilhite, Orangevale, CA (US)

(72) Inventor: Milo John Wilhite, Orangevale, CA (US)

( * ) Notice: Subject to any disclaimer, the term of this patent is extended or adjusted under 35 U.S.C. 154(b) by 0 days.

(21) Appl. No.: 14/997,477

(22) Filed: Jan. 15, 2016

(65) Prior Publication Data

US 2016/0243459 A1 Aug. 25, 2016

Related U.S. Application Data

(60) Provisional application No. 62/118,769, filed on Feb. 20, 2015.

(51) Int. Cl.

| | |
|---|---|
| ***A63J 7/00*** | (2006.01) |
| ***A63J 5/02*** | (2006.01) |
| ***F23D 14/46*** | (2006.01) |
| ***F23D 3/02*** | (2006.01) |
| *A63J 5/00* | (2006.01) |

(52) U.S. Cl.
CPC ..... *A63J 5/023* (2013.01); *A63J 7/00* (2013.01); *F23D 3/02* (2013.01); *F23D 14/46* (2013.01)

(58) Field of Classification Search
CPC ..... A63G 31/00; A63J 1/00; A63J 5/00; A63J 5/02; A63H 33/00; A63H 33/22; A63H 33/26; A63H 3/006
USPC ..... 472/614, 75, 81, 61; 446/26, 46, 47, 446/175, 219, 129, 137; 362/396, 362/398–399, 457
See application file for complete search history.

(56) References Cited

U.S. PATENT DOCUMENTS

| | | | | |
|---|---|---|---|---|
| 1,268,622 A * | 6/1918 | Reynolds | F21V 21/08 | 248/229.26 |
| 4,333,262 A * | 6/1982 | Kimura | A63H 29/24 | 136/291 |
| 5,573,017 A * | 11/1996 | Post | A44C 15/0015 | 132/275 |
| 6,254,486 B1 * | 7/2001 | Mathieu | A63F 9/0291 | 446/175 |
| 8,515,218 B2 * | 8/2013 | Hibbard | G02B 6/0008 | 362/555 |

* cited by examiner

*Primary Examiner* — Kien Nguyen

(57) ABSTRACT

The invention is a device used as a prop in dance and performances. In particular fire dancing, light performances and other performances such as belly dancing. The Specification describes the current need for a performance device that allows the user a greater freedom of movement and the ability to rapidly reconfigure the shape and function of the performance device. This device consists of a flat, crescent shaped body with a center area for gripping and two arms with attachments for wicks or lights. The device has holes in the grip area which allow the user to spin the device on a finger or thumb. The device has screw holes and, in some embodiment's, magnets, in the grip area and along the arms that allow the user to attach multiple units together to form difference shapes. Wicks or lights can easily be removed for rapid replacement or reconfiguration of props.

12 Claims, 24 Drawing Sheets

Device as a single unit with basic dimensions shown.

Figure 1. Device as a single unit with basic dimensions shown.
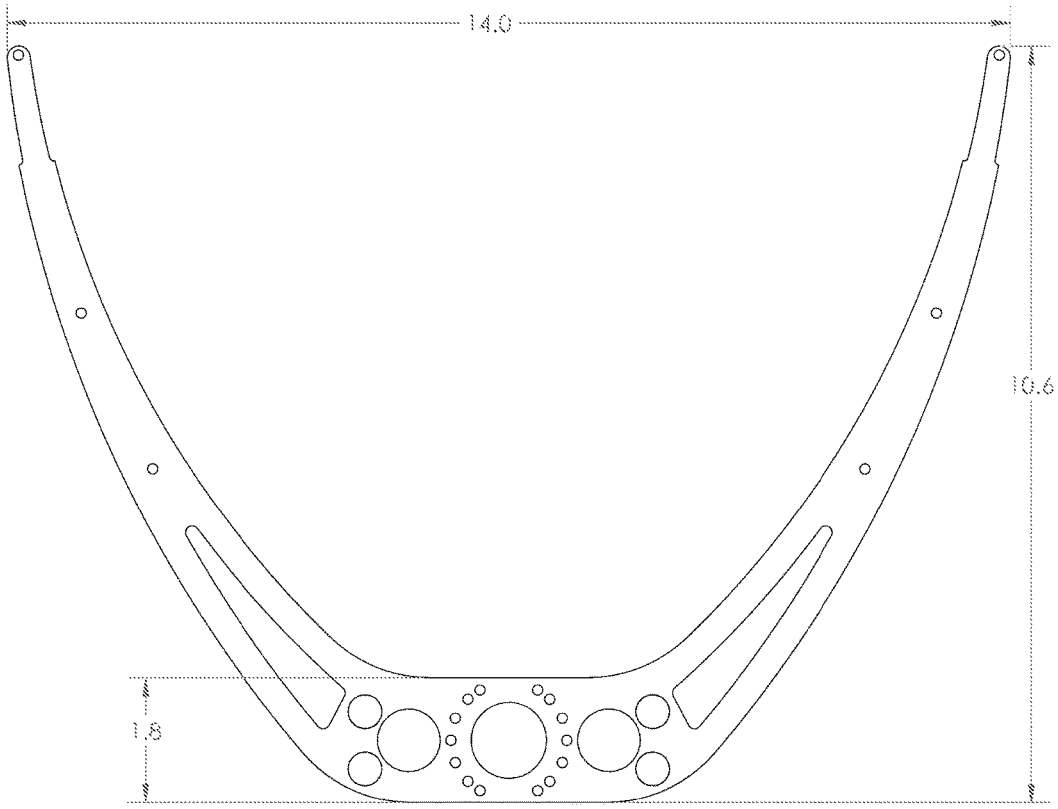

Figure 2. Device as a single unit with main components shown.
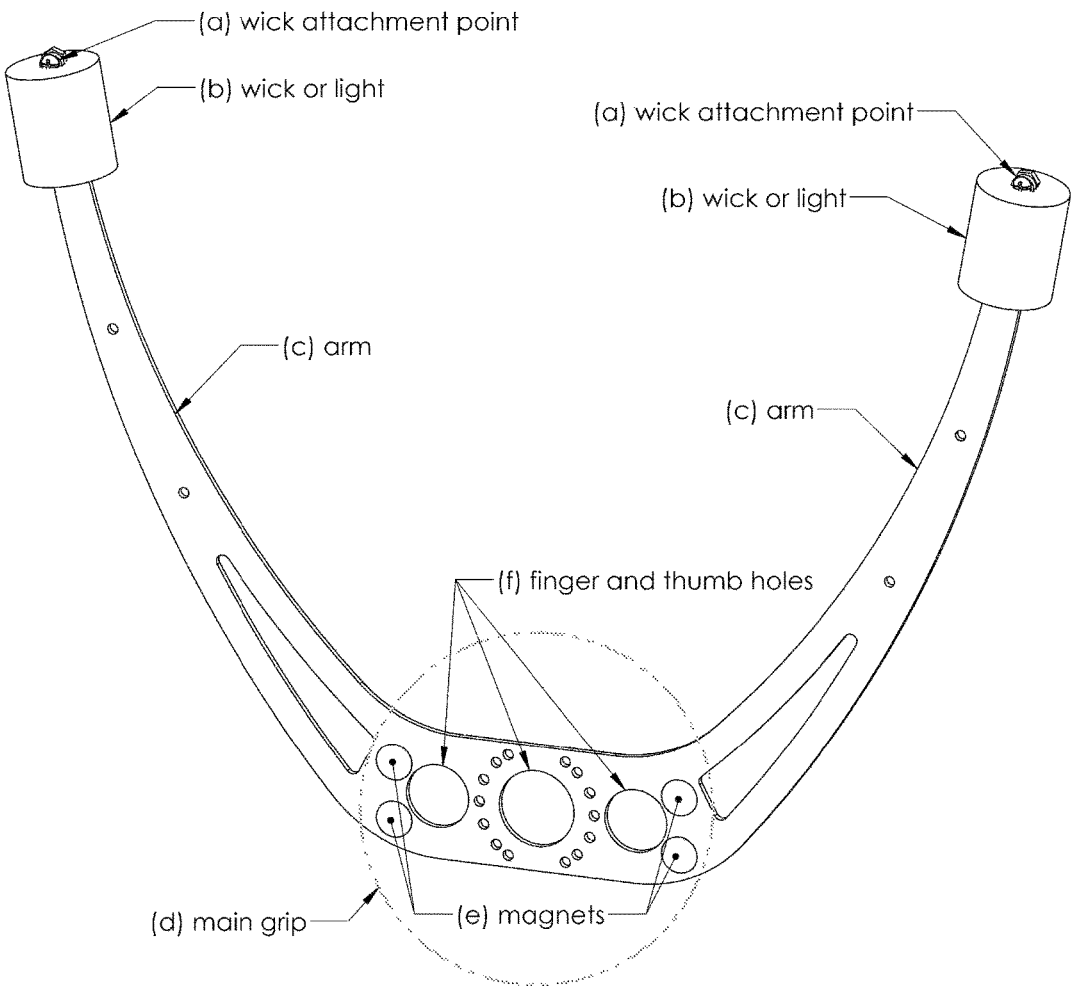

Figure 3. Device as two units attached in a "fan" configuration.
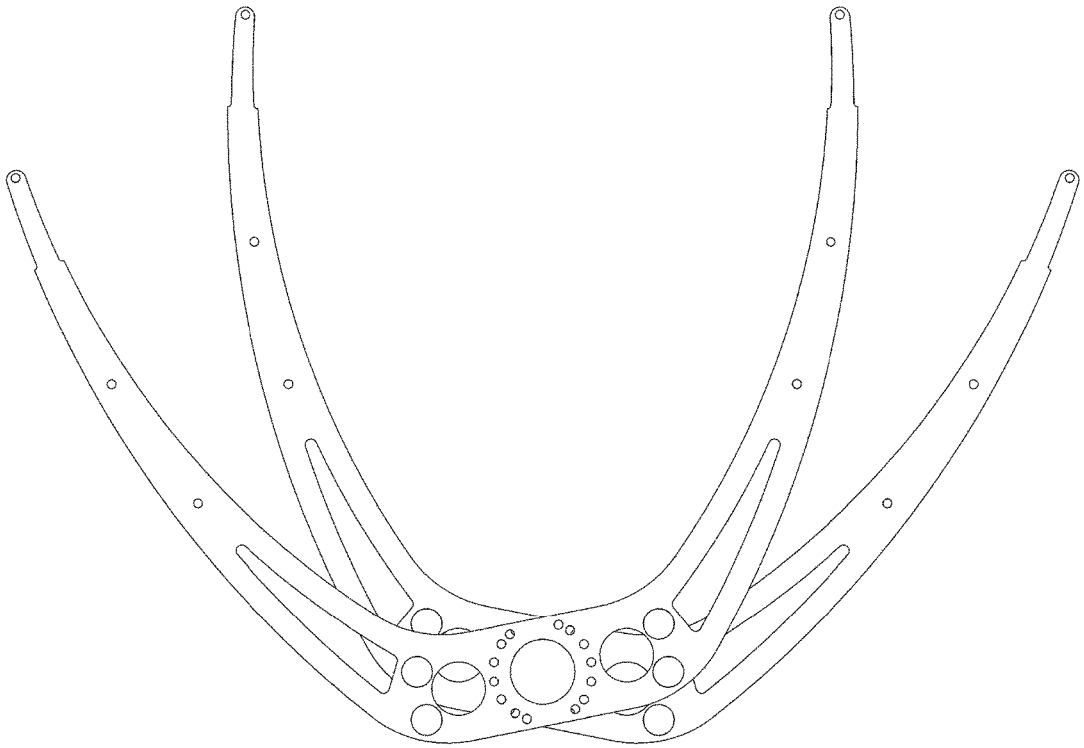

Figure 4. Device as three units attached in a "fan" configuration.
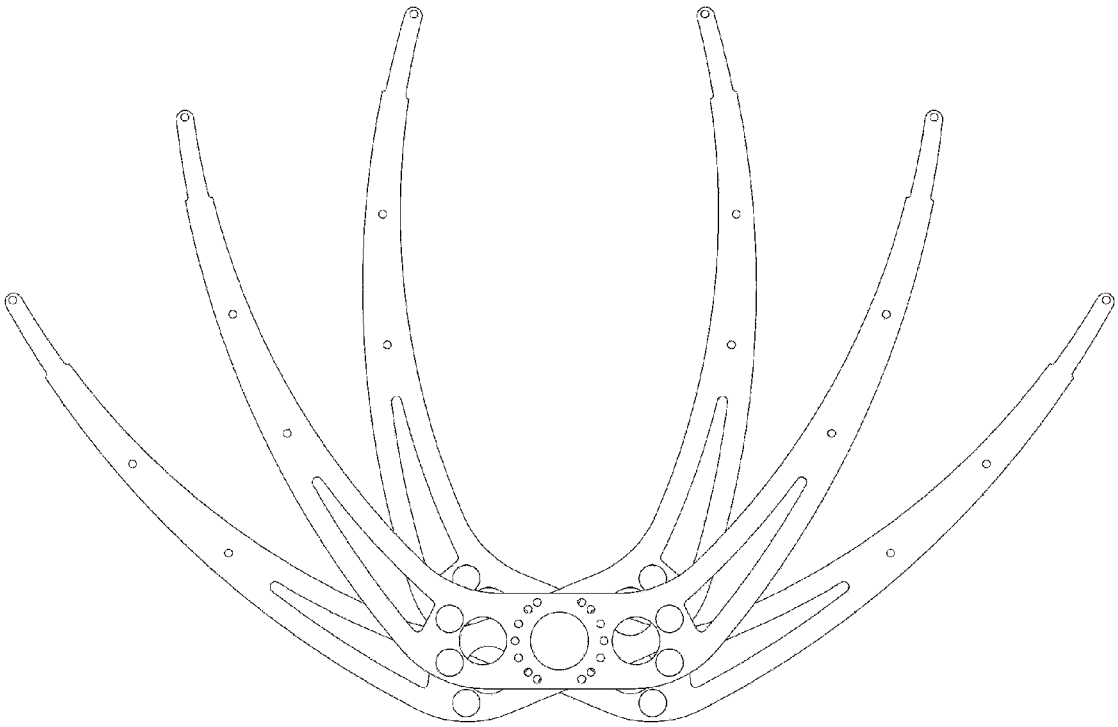

Figure 5. Device as four units attached in a "fan" configuration.
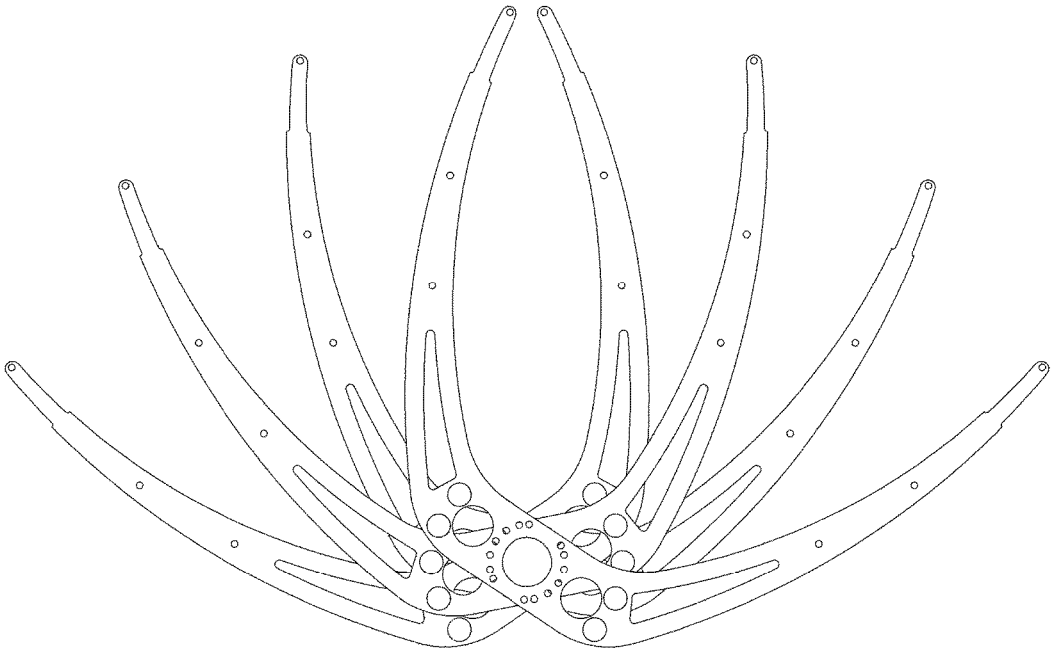

Figure 6. Device as two units attached in a "cross" configuration.
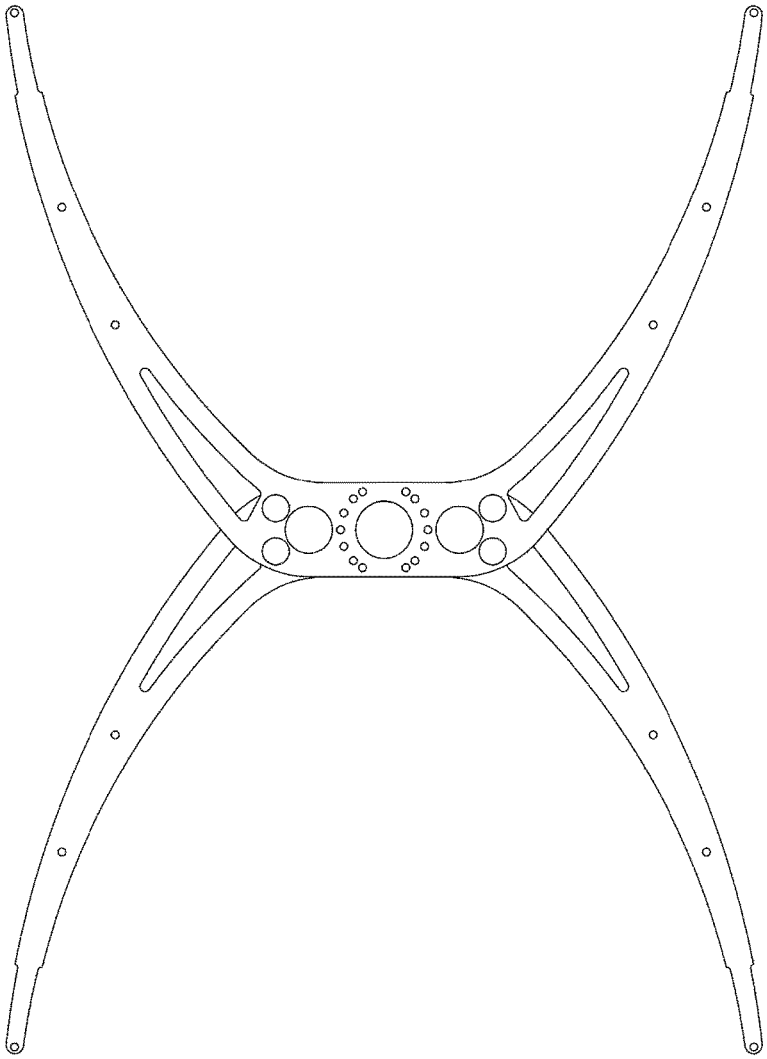

Figure 7. Device as three units in fan/cross configuration.
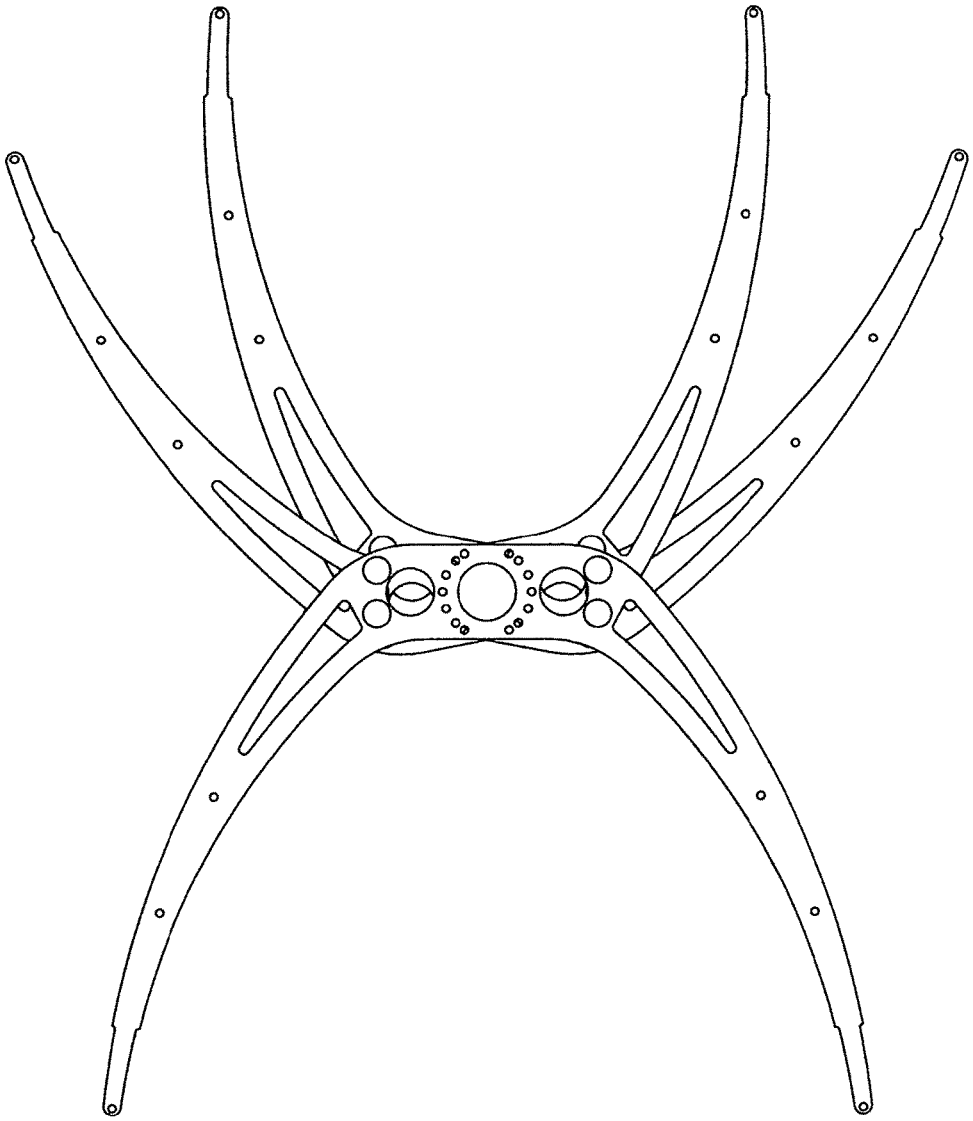

Figure 8. Device as three units in star configuration.
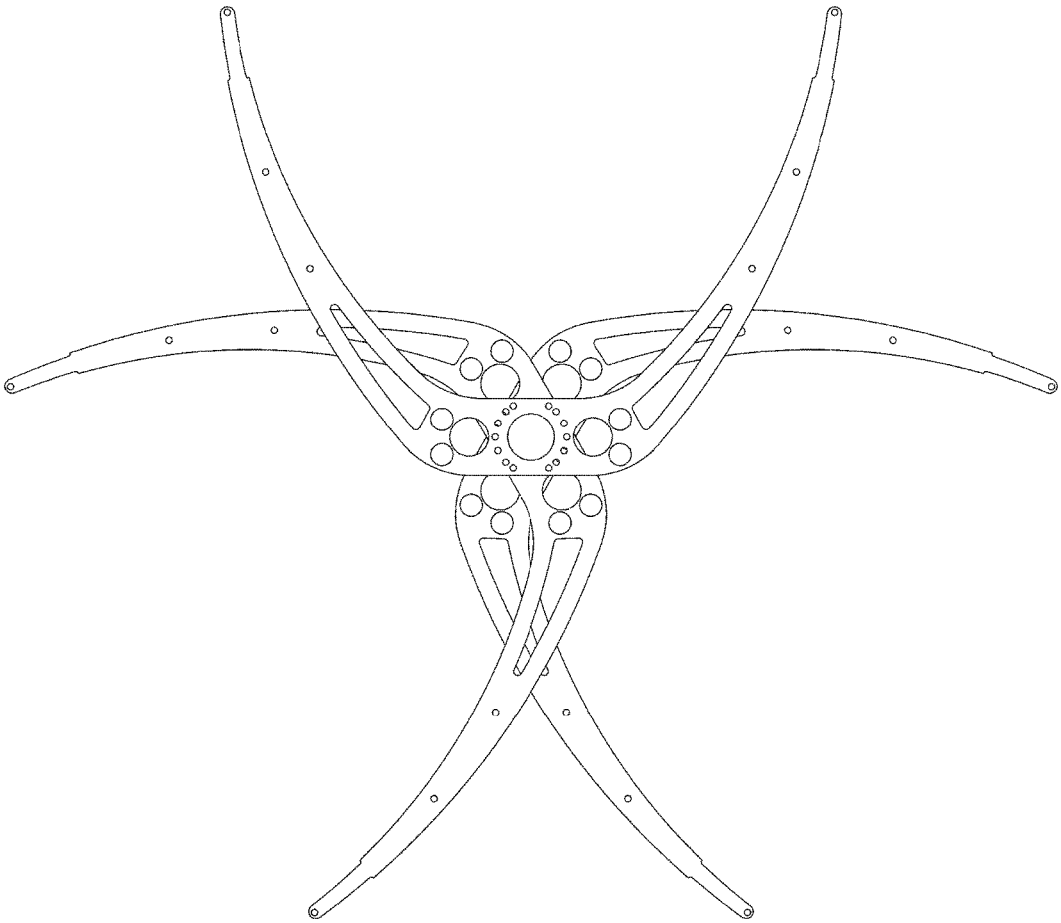

Figure 9. Device as four units in cross configuration.
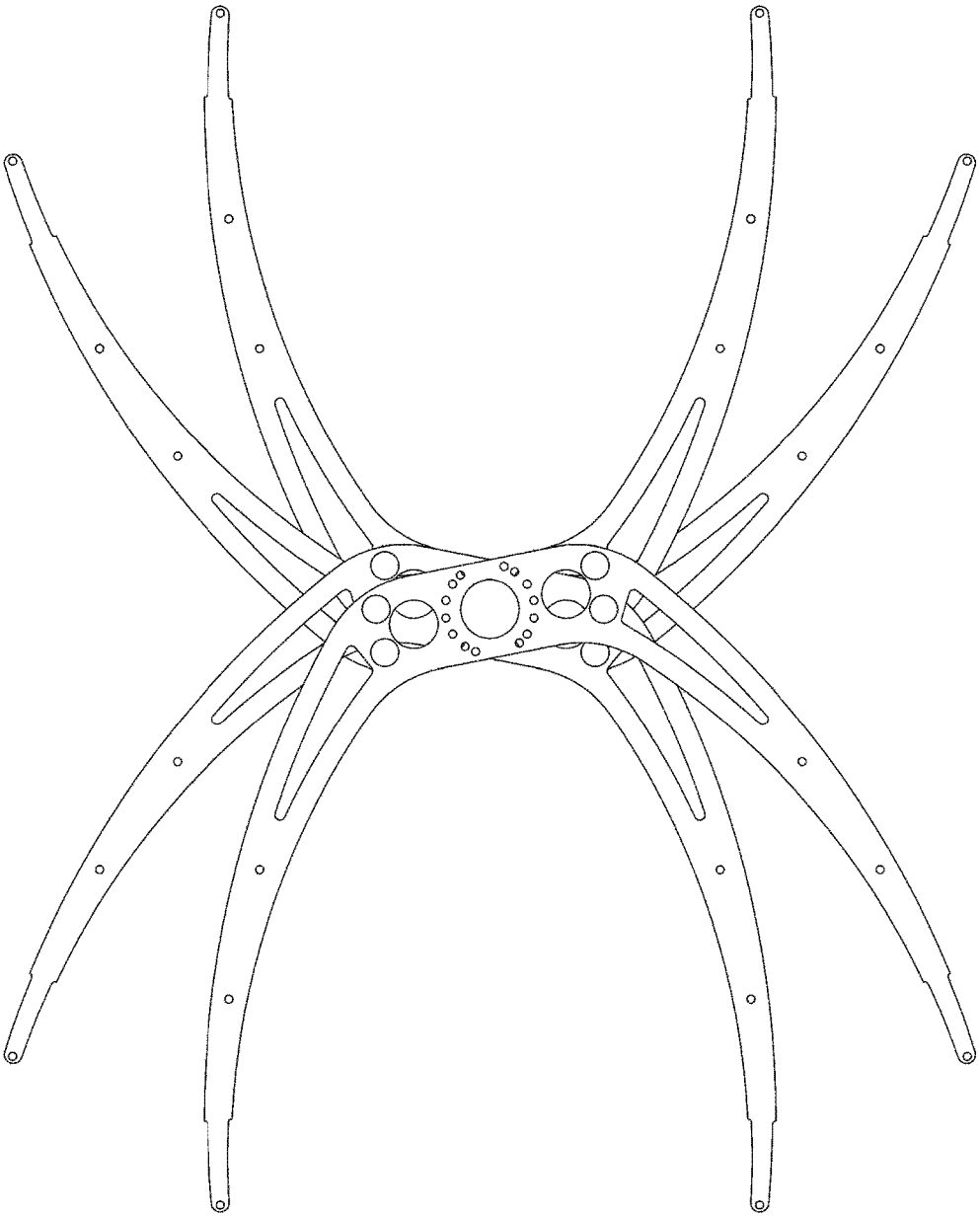

Figure 10. Device as four units in fan/cross configuration.
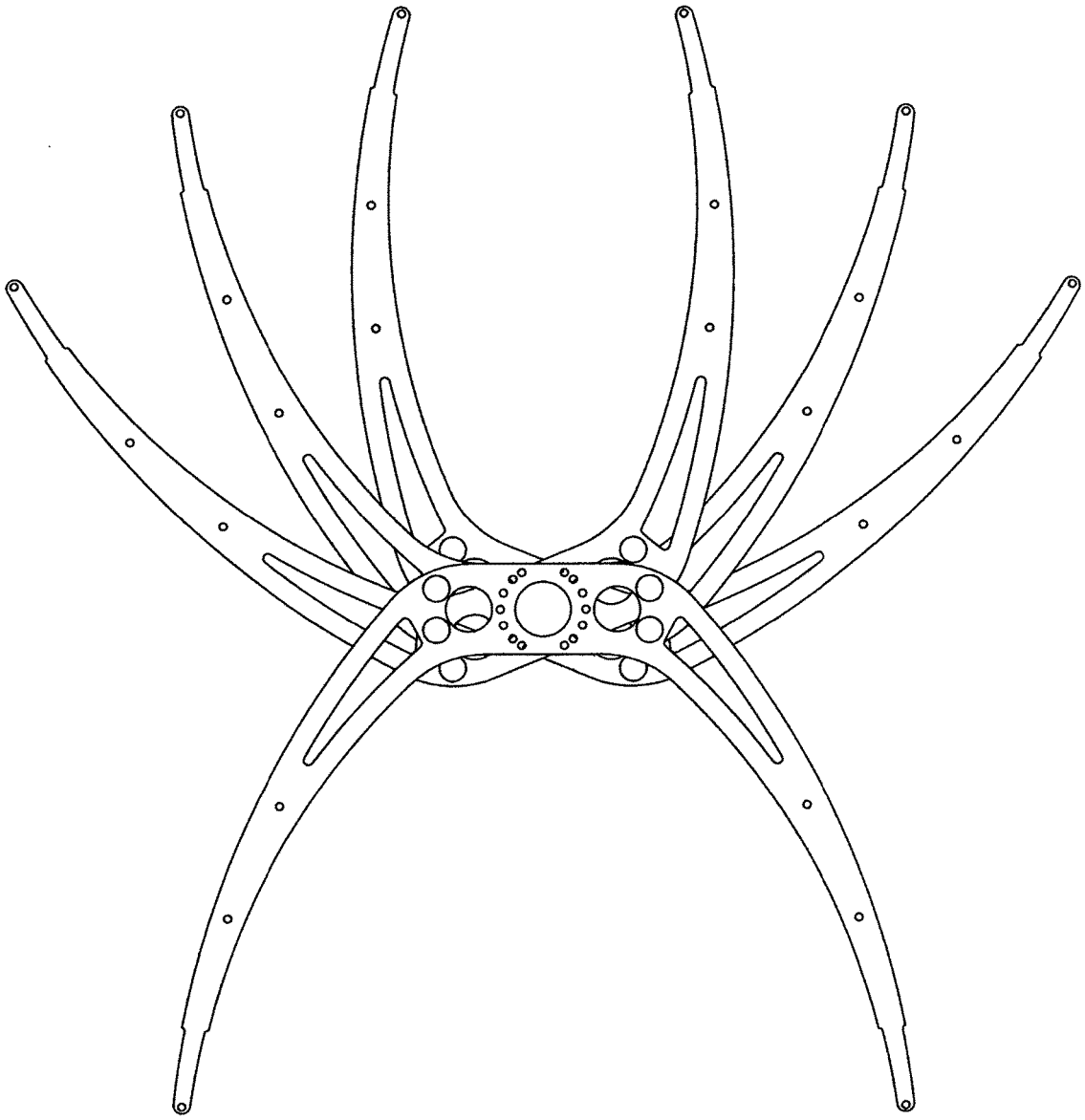

Figure 11. Device as four units in star configuration.
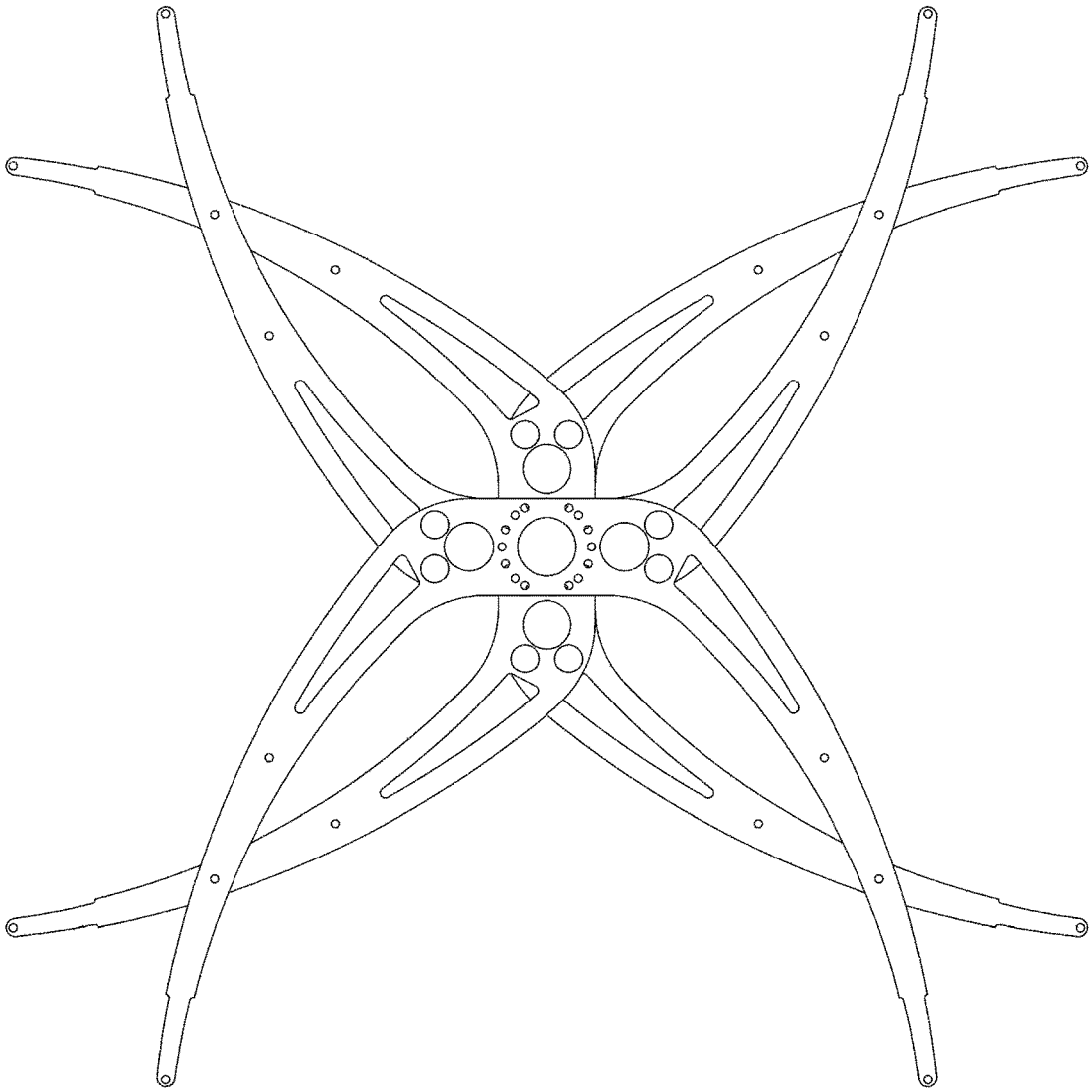

Figure 12. Device as two units attached in a "circle" configuration.
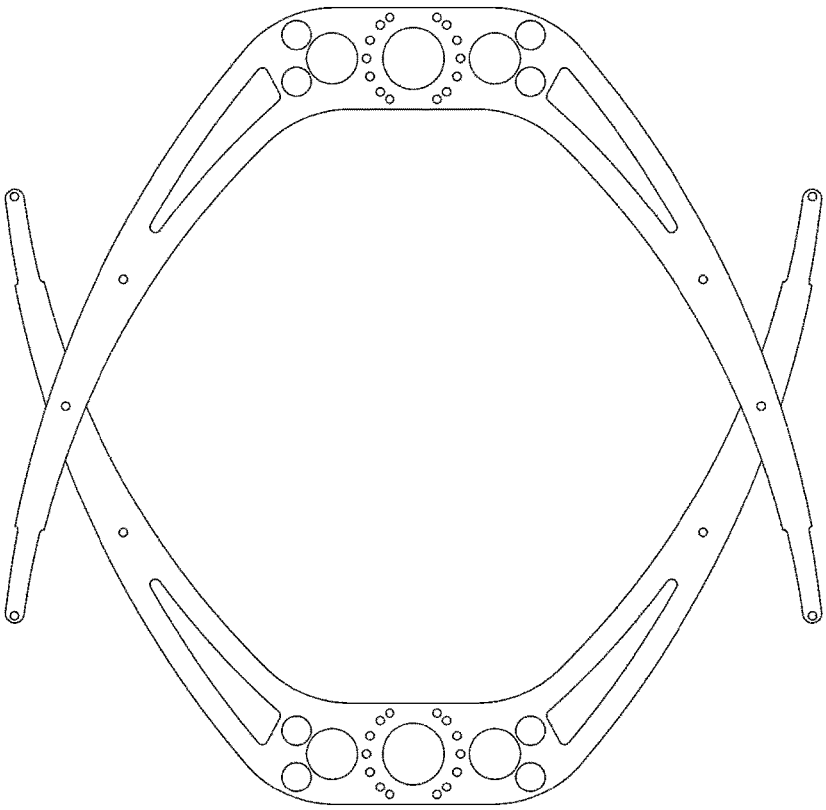

Figure 13. Device as two units attached in an alternate "circle" configuration.
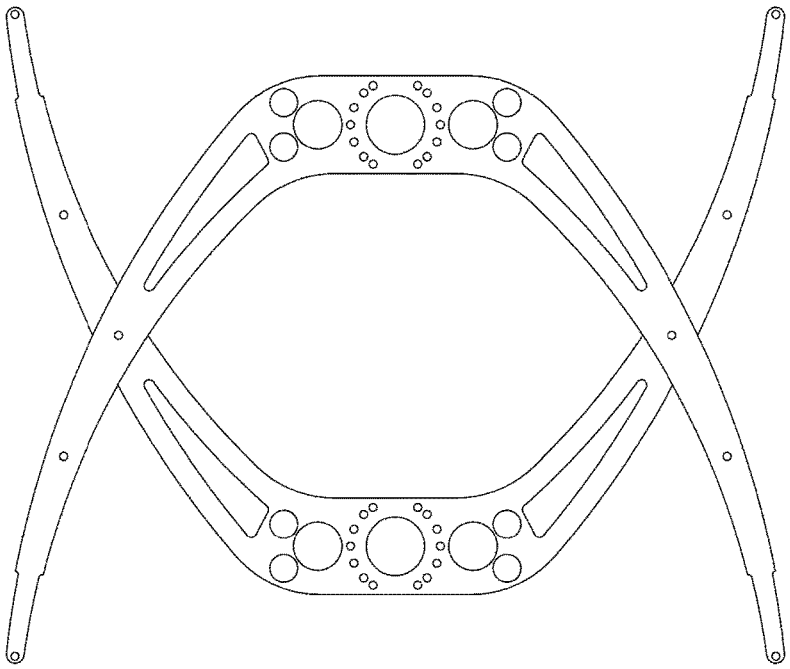

Figure 14. Device as two units attached in an alternate "circle" configuration.
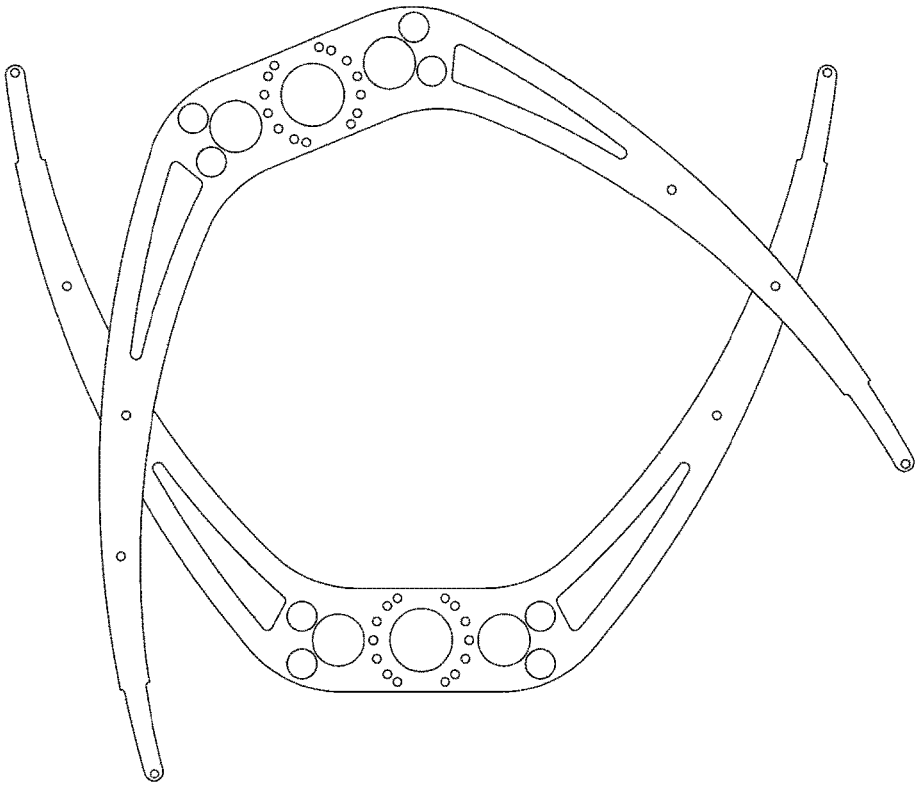

Figure 15. Device as two units attached in an "S" configuration.
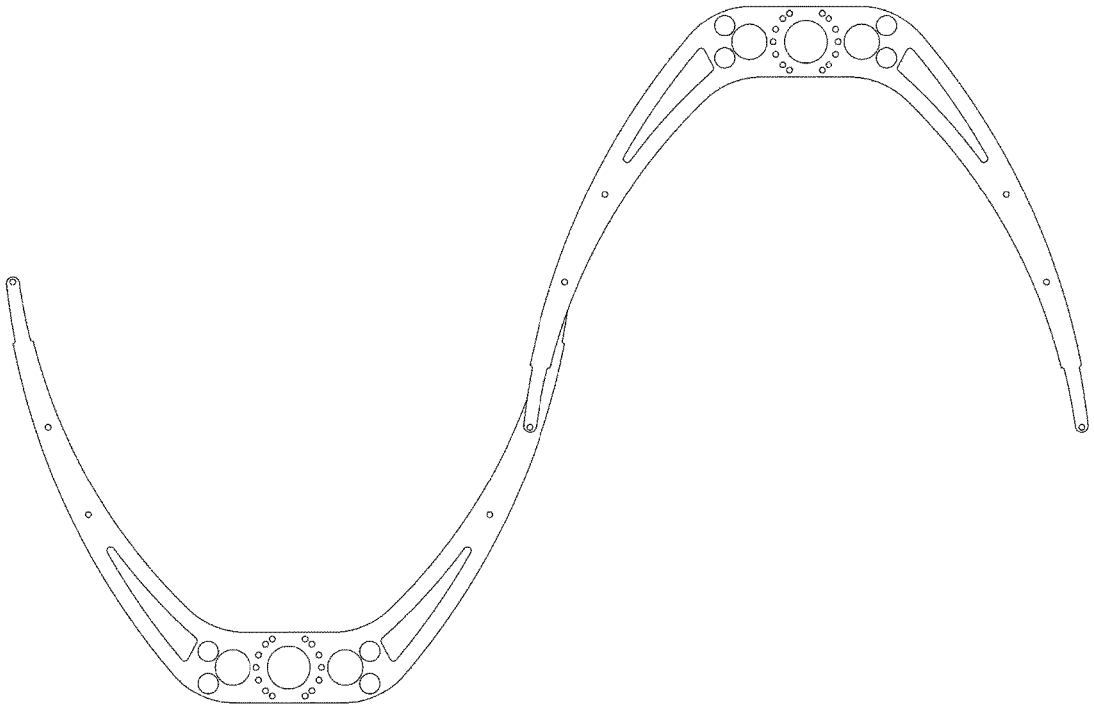

Figure 16. Device as two units in "S" configuration with finger loop.
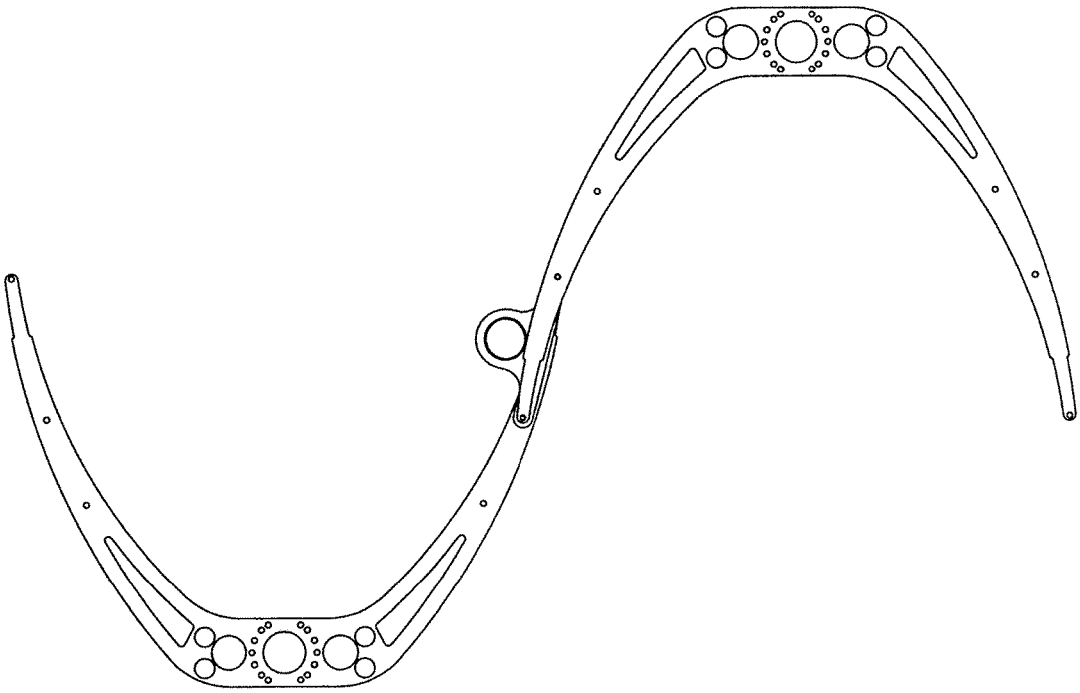

Figure 17. Device as two units attached in an alternate "S" configuration.
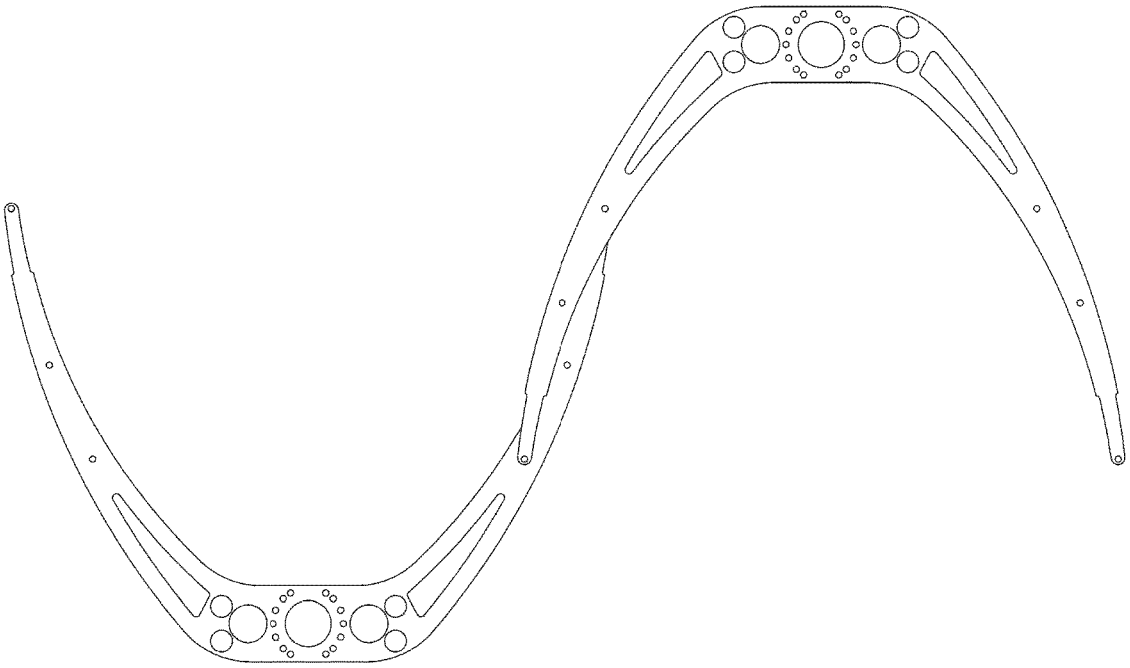

Figure 18. Device as four units attached in an double "S" configuration.
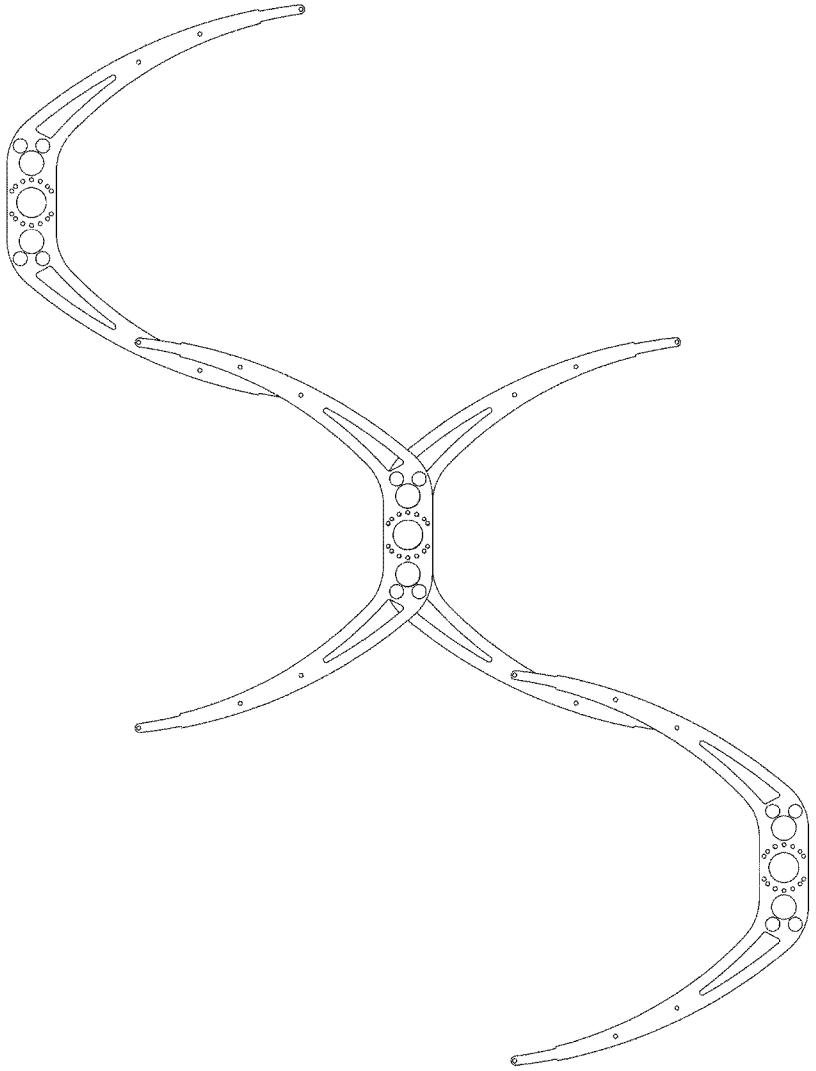

Figure 19. Device as six units attached in an alternate double "S" configuration.
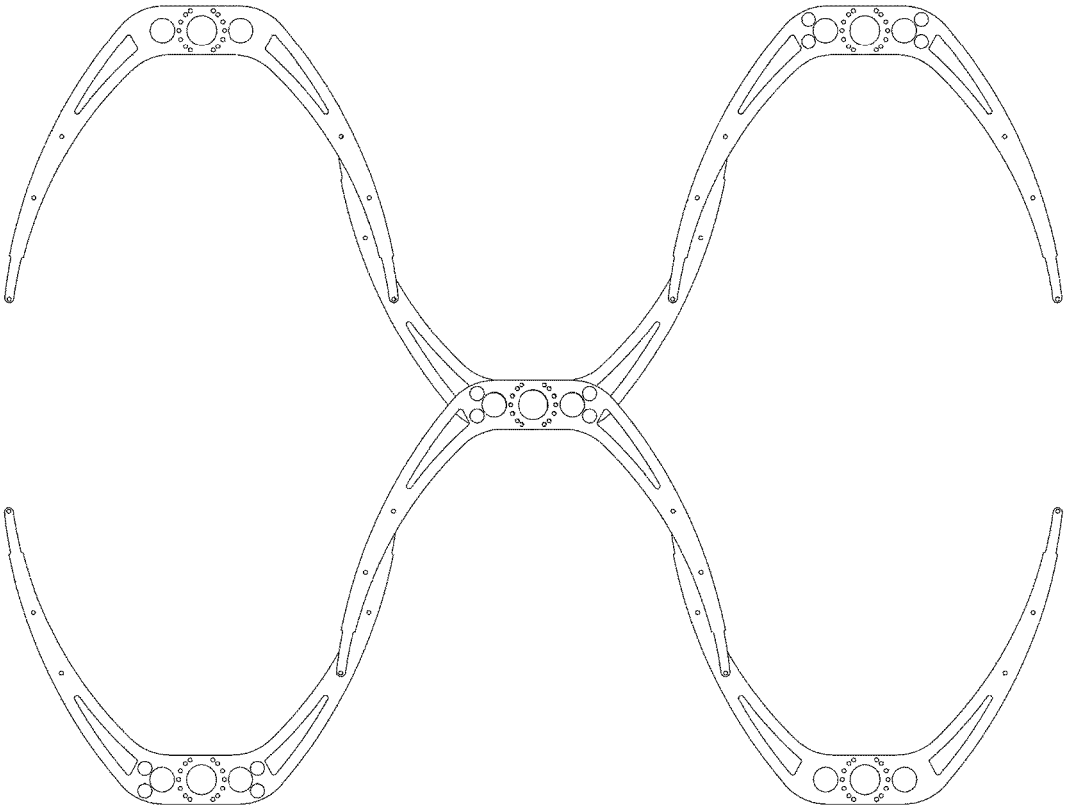

Figure 20. Device being passed over body parts or objects.
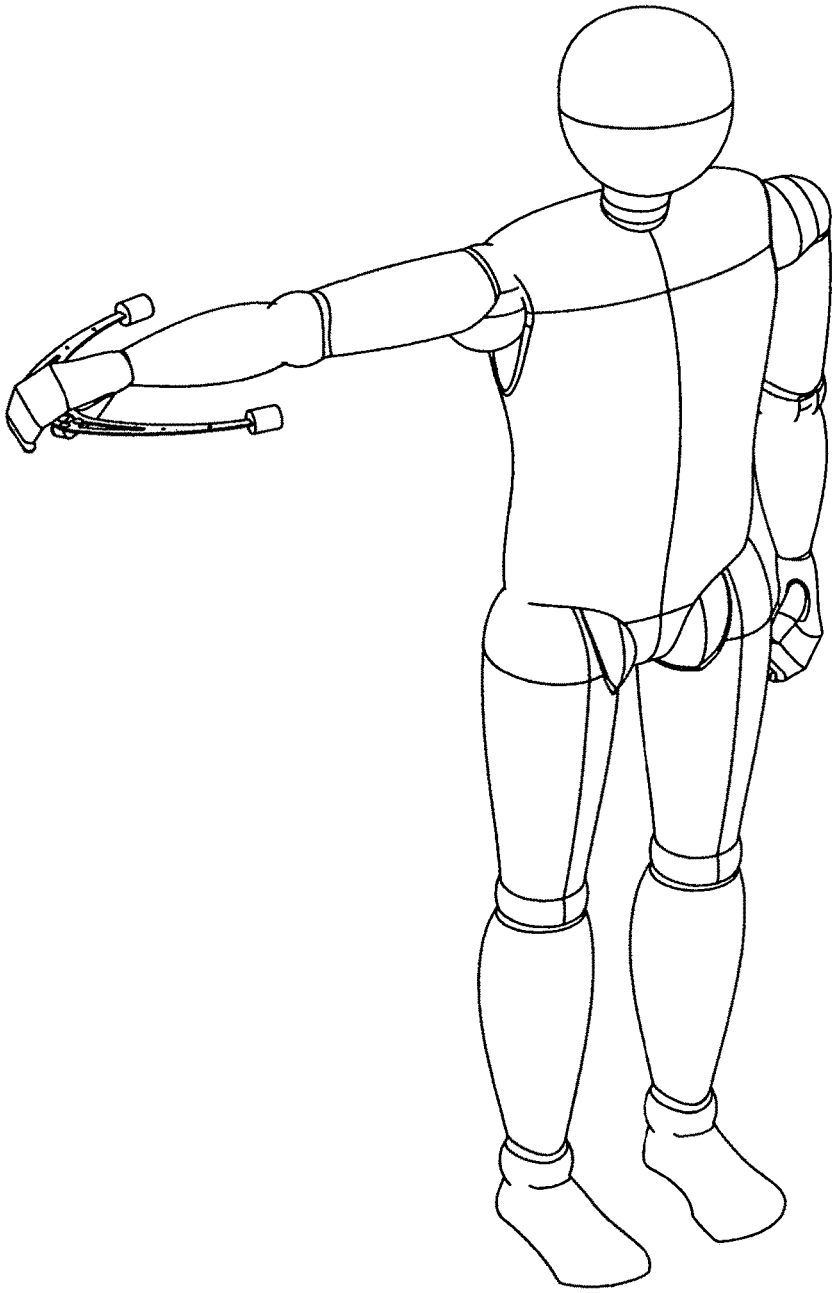

Figure 21. Device being passed over body parts or objects.
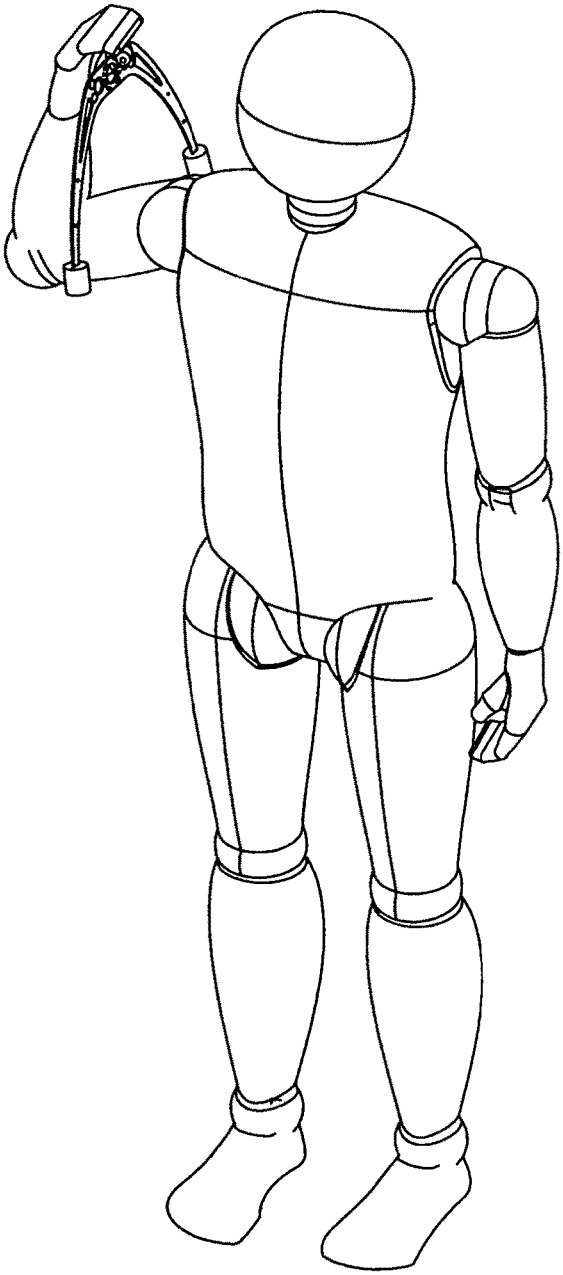

Figure 22. Device being passed over body parts or objects.
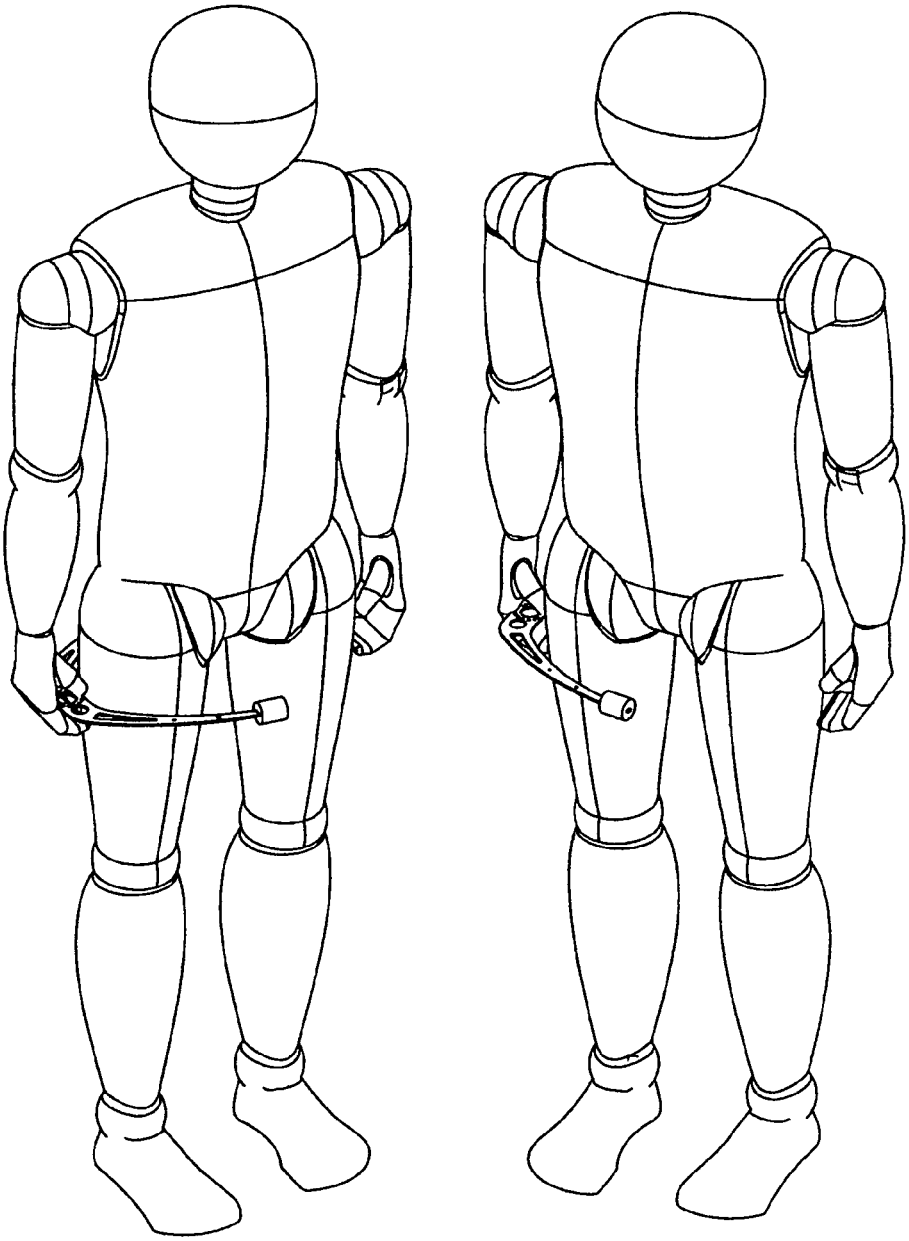

Figure 23. Device as a single unit with removable grips installed.
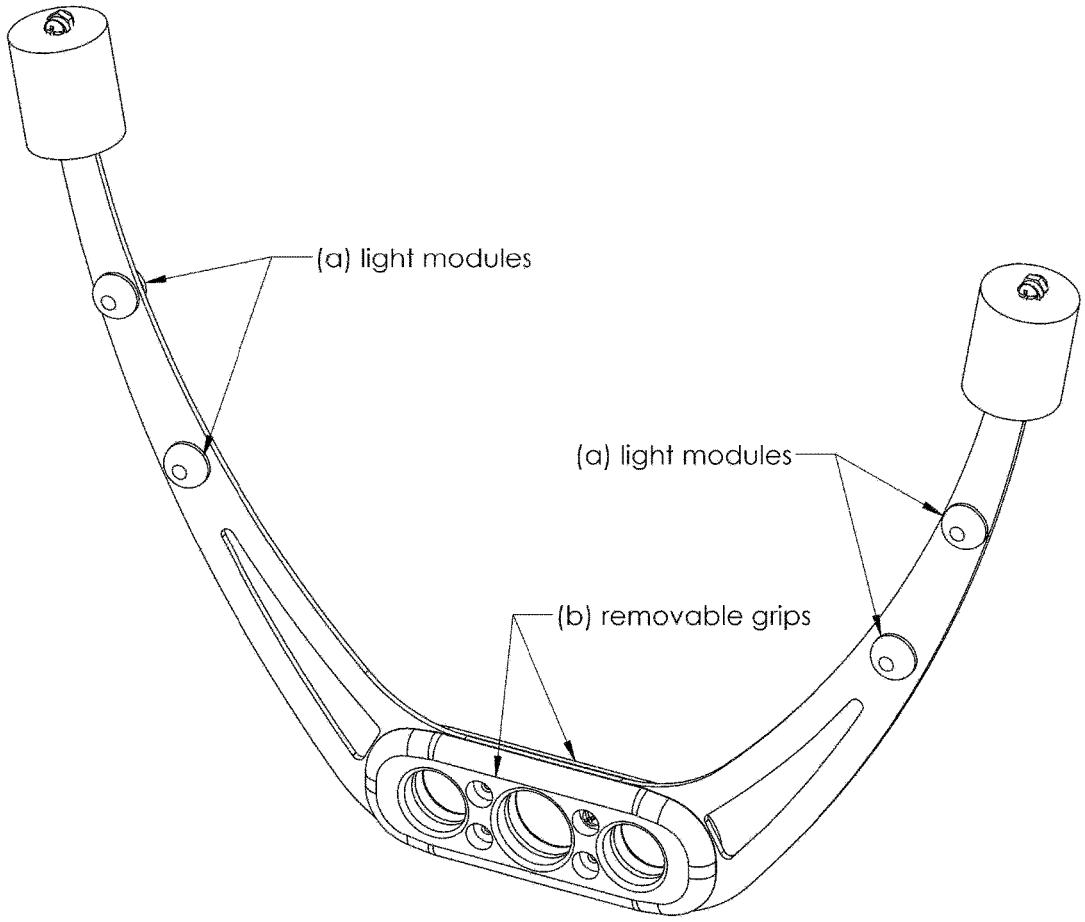

Figure 24. Finger loop bracket.
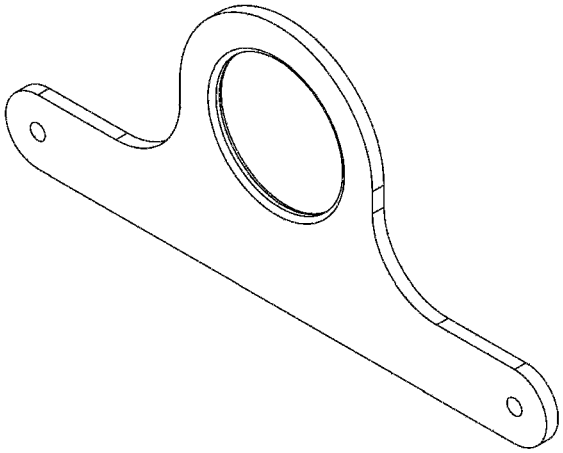

DEVICE FOR FIRE, LIGHT AND DANCE PERFORMANCE

FIELD OF INVENTION

The invention described herein is a device used as a prop in dance and performances. In particular fire dancing, light/LED performances and other dancing or performances such as belly dancing.

BACKGROUND OF INVENTION

Props have been used extensively throughout history to augment/enhance performances, sometimes for payment of entertainment, or exercise or just for fun. In recent years the use of fire to augment/enhance performances has become very popular and is a growing field. The performers require special props designed such that they can dance, move and otherwise perform with fire. These props allow the performer to light a wick(s) which has been soaked in a fuel and is attached to the prop and then manipulate the prop without burning the performer.

At the present there does not exist a device that allows the user to manipulate a performance prop such that a portion of the body, such as an arm, or an object, may be passed through it. If a performer were able to move a performance prop in such a way it would allow the performer a much greater degree of freedom and range of movement with the prop.

At the present time there does not exist a device that allows the user to rapidly remove or install wicks or lights on a performance prop. The rapid removal of wicks would allow the user to install new wicks, wicks of different size and type, lights in place of wicks, or to remove one or both of the wicks from each prop and attach the props together, arm to arm, to form new shapes, thus allowing for more varied or diverse types of performances, or shorter preparation time between performance sets.

At the present time there does not exist a device that allows the user to modulate the shape and function of a performance prop thus being able to make multiple different props from two or more of the same base units. Current props on the market have a singular use that they are designed for.

At the present time there does not exist a device that allows the user to rapidly remove or install grips or handles or other performance or comfort enhancing modules on a performance prop. The rapid grips or modules would allow the user to install new grips or modules, grips or modules of different size and type, light up grips such as color changing LED, or light modules, or any combination of modules, thus allowing for more varied or diverse types of performances, or shorter preparation time between performance sets.

DESCRIPTION OF THE INVENTION

It is an object of the present invention to provide a device that allows the performer or other user to manipulate a performance prop such that a portion of the body, such as an arm, or an object, may be passed through the performance prop, with this device resulting in allowing the performer a greater degree of freedom and range of movement with the prop during performance or other activities, with this device specifically being a fire or light performance prop shaped such that it can be rotated 360 degrees in the hand of the performer, allowing the arm to pass through it and between the wicks of the prop and additionally with this prop allowing the performer or other user to move the prop along other portions of the body such as legs or torso with said portion of the body being between the wicks.

It is an additional object of the present invention to provide a device that allows the performer or other user to rapidly remove or install wicks or lights on a performance prop, with this device allowing the performer or user to rapidly remove wicks and/or install new wick on the performance prop, with this device allowing the installation of wicks of different size and type, lights in place of wicks, or a combination of wicks and lights, with this device allowing wicks and lights to be configured to the prop in such a way as to result in the formation of new shapes or configuration of props, thus allowing for more varied or diverse types props that can be used in more varied or diverse types of performances, or shorter preparation time between performance sets.

It is an additional object of the present invention to provide a device that allows the performer or other user to modulate the shape and function of a performance prop, with this device being comprised of sub-units such that these sub-units allow the performer or other user to variously configure the constituent sub-units of the device resulting in multiple different forms of the reconfigured sub-units, allowing the user to compose multiple forms of performance props from two or more of constituent sub-unit device(s).

It is an additional object of the present invention to provide a device that allows the performer or other user to rapidly remove or install grips or handles or other performance or comfort enhancing modules on a performance prop, with this device allowing the performer or user to rapidly remove grips or modules and/or install new grips or modules on the performance prop, with this device allowing the installation of grips or modules of different size and type, light up grips such as color changing LED, or a combination of grips and modules, with this device allowing grips or modules to be configured to the prop in such a way as to result in the formation of new shapes or configuration of props, thus allowing for more varied or diverse types props that can be used in more varied or diverse types of performances, or shorter preparation time between performance sets.

The primary embodiment of this invention is shown in figures (001) and (002). Device is a crescent shape about 13" tall and 14" wide and 0.09" thick, with center section (d) of device (002) of the crescent is the main handle area and is about 1.75" wide with holes (f) which a finger or thumb may be passed allowing the performer to spin the device (002) around finger or thumb. The arms (c) of the crescent taper from the 1.75" width at the main grip (d) down to about ⅜" at the ends (a) of the arms (c) where the wicks (b) and wick attachment points (a) are located. In some embodiment's, the length of the arms, or the relative angles of the arms, or the thickness of the device, or the relative placement of the holes, or the proportions of the main grip area or any other feature may be altered. In some embodiments the device is made from high strength aluminum alloy. In other embodiments the device is made from steel, carbon fiber, composite, or other materials. In some embodiments the device is made from multiple types of material that are joined together in a manner known in the art. The use of high strength aluminum or composites will facilitate a lightweight and durable design while not conducting heat to the performers hand. In some embodiment's, the device finish can be bare aluminum, or the device can be plated, such as anodized, painted or powder coated, in any color or combination of colors, as is known in the art. In some embodiment's, the device can be used with wicks or lights on the ends of the arms. In other embodiments the device can be used without wicks or lights.

In an example of the first embodiment, the performer could use any of the finger holes to spin the device around a finger. In another example, the performer could move the device such that an object or portion of the body could pass between the wicks or lights (020, 021, 022).

The second embodiment of this invention, shown in figure (003) comprises of rapidly removable and replaceable wicks (a). The wicks (a) are removable by removing the fasteners (b) at the very end of the arms and sliding the wicks (a) off. New wicks, or wicks of different size and type, or light modules, such as color changing LED, may then be slid on in place of the removed wicks and the fasteners re-installed. Removal of one or both of the wicks from each unit also facilitates the function of attaching the units together, arm to arm, to form new shapes. In some embodiment's two units can be attached together to form an "S" shape (015, 016, 017). In other embodiment's 4 or more units can be attached together to form double "S" shapes (018, 019).

In an example of the second embodiment, a performer needs to replace worn out wicks or would like to use larger wicks or use light modules, the performer simply removes the fasteners at the ends of the arms and slides the wicks off and the new ones on. In another example, the performer wants to use the device in an alternate configuration with additional units. The performer simply removes the fasteners at the end(s) of the arm(s) and slides one or more of the wicks off and then uses the same fasteners to attach multiple devices together (015, 016, 017, 018, 019).

The third embodiment of this invention, shown in figures (004-020), comprises of unit re-configurations with, and without the need of tools. Multiple units can be attached together in a variety of arrangements using one of a plurality of attachment means. In some embodiments, the attachment means are built in magnets (002*e*), with this configuration being suitable for rapid, temporary assembly and/or rapid reconfiguration, including reconfiguration during a performance. In other embodiment's, the attachment means are fasteners such as threaded bolts and nuts, used for a more solid assembly. In other embodiment's, other attachment means known in the art are used. In some embodiment's, the device can be used as an individual unit. In other embodiment's, one device is combined with one or more additional devices to form one or more configurations of coupled devices.

In an example of the 3rd embodiment, two or more devices can be configured such that they form "fan" configurations (003, 004, 005) or variations of the "fan" configurations (007, 010). In another example of the 3rd embodiment, two or more devices can be configured such that they form "cross" configurations (006, 009). In another example of the 3rd embodiment, two or more devices can be configured such that they form "star" configurations (008, 011). In another example of the 3rd embodiment, two or more devices can be configured such that they form "circle" configurations (012, 013, 014). In another example of the 3rd embodiment, two or more devices can be configured such that they form "S" configurations (015, 016, 017), or variations of the "S" configurations (018, 019).

The fourth embodiment of this invention, shown in figure (023) comprises of rapidly removable and replaceable grips or handles (b), or performance or comfort enhancing modules such as color changing LED modules (a). The grips (b) or other modules are held in place by one or more of a plurality of attachment means. In some embodiments, the attachment means are built in magnets, with this configuration being suitable for rapid, temporary assembly and/or rapid reconfiguration, including reconfiguration during a performance. In other embodiment's, the attachment means are fasteners such as threaded bolts and nuts, used for a more solid assembly. In other embodiment's, other attachment means known in the art are used. In other embodiments, the grips, or other modules, may have light modules in them, such as color changing LED.

In an example of the 4th embodiment, the performer may use the device as single units or in any variety of configurations of any number of units, the performer may then snap, or secure, grips onto the device to achieve a more comfortable grip or handle. The performer may choose to affix grips with lights in them or other light modules to enhance the performance through the use of any single color or color changing lights.

BRIEF DESCRIPTION OF FIGURES

FIG. 1. Device as a single unit with basic dimensions shown.

FIG. 2. Device as a single unit with main components shown.

FIG. 3. Device as two units attached in a "fan" configuration.

FIG. 4. Device as three units attached in a "fan" configuration.

FIG. 5. Device as four units attached in a "fan" configuration.

FIG. 6. Device as two units attached in a "cross" configuration.

FIG. 7. Device as three units with two in "fan" configuration as in figure and a third flipped in "cross" configuration.

FIG. 8. Device as three units in "star" configuration.

FIG. 9. Device as four units in "cross" configuration.

FIG. 10. Device as four units with three in "fan" configuration and a third flipped in "cross" configuration.

FIG. 11. Device as four units in "star" configuration.

FIG. 12. Device as two units attached in a "circle" configuration.

FIG. 13. Device as two units attached in an alternate "circle" configuration.

FIG. 14. Device as two units attached in an alternate "circle" configuration.

FIG. 15. Device as two units attached in an "S" configuration.

FIG. 16. Device as two units attached in an "S" configuration with a finger loop bracket also installed. This additional finger loop bracket will allow the user to spin the "S" configuration around user's finger.

FIG. 17. Device as two units attached in an alternate "S" configuration.

FIG. 18. Device as four units attached in a double "S" configuration.

FIG. 19. Device as six units attached in an alternate double "S" configuration.

FIG. 20. Person holding a single device showing the range of movement allowed by rotating the device 360 degrees in the wrist. Figure shows the device as the wicks pass on either side of the fore arm.

FIG. 21. Images of persons holding a single device showing how the device can be passed over portions of the body or other objects. Figure shows the device as the wicks pass on either side of the upper arm.

FIG. 22. Images of persons holding a single device showing how the device can be passed over portions of the body or other objects. Figure shows the device as the wicks pas on either side of the leg.

FIG. 23. Device as a single unit with removable grips and light modules shown.

FIG. 24. Finger loop bracket. Allows user to mount bracket to devise to add an extra finger loop where needed.

The embodiments of the invention in which an exclusive property or privilege is claimed are defined as follows:

1. A device for fire, light and dance performance designed to maximize range of motion and ease of manipulation, to held in the hand, untethered such that said device can be tossed, transferred or released if needed by simply opening of the user's hand, and comprising of: a single, rigid, flat, unbent, U-shaped, armature with a lower grip section used for holding, manipulating, tossing, and catching in the hand of the user, with said lower grip section also used for attaching a plurality of said devices together, and two upper arm sections extending outward and upward from said lower grip section with a fire wick or LED attached to each end of the upper arm sections and the zone above the lower grip section, and encompassed by the upper arm sections and wicks on either side, left open and large enough to allow free passage of the user's hand, arm, leg, body or other objects between said upper arm sections and wicks during use.

2. The device defined in claim 1, where said lower grip section contains a series of magnets that are used to attach multiple devices together.

3. The device defined in claim 1, where said lower grip section contains a series of holes that are used, in combination with screws or other hardware, to attach multiple devices together.

4. The device defined in claim 3, where the series of holes in said lower grip section are used to attach comfort grips where the comfort grips are separate pieces attached one on each side of said lower grip section using screws or other hardware.

5. The device defined in claim 1, where said lower grip section contains a series of larger holes used for manipulation of the device with a finger or thumb.

6. The device defined in claim 1, where said upper arm sections have a series of holes that are used, in combination with screws or other hardware, to attach multiple devices together.

7. The device defined in claim 1, where said upper arm sections have a series of magnets that are used to attach multiple devices together.

8. The device defined in claim 1, where said upper arm sections have cut out sections for lightening and cooling purposes.

9. The device defined in claim 1, where said upper arm sections have a series of holes that are used, in combination with screws or other hardware, to attach wicks or lights.

10. A combination defined in claim 9, where the wicks are attached to said upper arm sections in a removable fashion using screws and nuts, wire, glue, magnets or other hardware.

11. A combination defined in claim 9, where the lights are attached to said upper arm sections in a removable fashion using screws and nuts, wire, glue, magnets or other hardware.

12. A combination defined in claim 9, where said upper arm sections have narrow portions at the ends designed to mount wicks and lights in a socket and post fashion.

* * * * *